United States Patent [19]

Fromson

[11] 4,131,518

[45] Dec. 26, 1978

[54] PROCESS FOR ANODIZING ALUMINUM

[76] Inventor: Howard A. Fromson, 15 Rogues Ridge Rd., Weston, Conn. 06880

[21] Appl. No.: 817,463

[22] Filed: Jul. 19, 1977

Related U.S. Application Data

[62] Division of Ser. No. 651,018, Jan. 21, 1976, Pat. No. 4,065,364.

[51] Int. Cl.[2] ..... C25D 11/04; C25D 11/16

[52] U.S. Cl. ..... 204/38 A; 204/15; 428/461; 428/464; 428/469

[58] Field of Search ..... 204/15, 28, 58, 17, 204/18 R, 38 A; 156/150, 281, 324; 428/650, 457, 464, 469, 461

[56] References Cited

U.S. PATENT DOCUMENTS

| | | | |
|---|---|---|---|
| 2,538,317 | 1/1951 | Mason et al. | 204/28 |
| 3,270,401 | 9/1966 | Staley et al. | 204/15 |
| 3,647,645 | 3/1972 | Carrillo et al. | 204/15 |
| 4,022,670 | 5/1977 | Dean | 204/58 |

FOREIGN PATENT DOCUMENTS

| | | | |
|---|---|---|---|
| 1214510 | 4/1956 | Fed. Rep. of Germany | 204/28 |

*Primary Examiner*—T. M. Tufariello

*Attorney, Agent, or Firm*—Sprung, Felfe, Horn, Lynch & Kramer

[57] ABSTRACT

Aluminum foil in the form of a continuous web for example, is anodically oxidized by first coating one side of the web with a material such as a polymeric material which is inert to the anodizing conditions and then electrolytically anodizing the uncoated side of the web. The laminate formed which can be used as a base plate for presensitized and wipe-on lithographic printing plates includes an aluminum foil coated on one side with an inert material and having an anodically oxidized layer on the other side which is formed after the one side is coated with the inert material.

8 Claims, 5 Drawing Figures

PROCESS FOR ANODIZING ALUMINUM

BACKGROUND

This is a division of application Ser. No. 651,018, filed Jan. 21, 1976 now U.S. Pat. No. 4, 065,364.

This invention relates to a process for anodically oxidizing aluminum and to products produced by such process. The term aluminum is used herein to include aluminum base alloys which, like pure aluminum can be electrolytically anodized to form oxide coatings or layers. More particularly, this invention relates to an improved process for anodically oxidizing continuous webs of relatively thin aluminum foil to produce a laminated anodized aluminum article which can readily replace articles presently made from aluminum sheet which is anodized on both side, for example base plates for lithographic printing plates.

Aluminum and aluminum base alloys in sheet and strip form have been continuously anodized by a number of techniques for many years. Such anodized products are used for electrical and decorative purposes, in the manufacture of household appliances, automotive trim, building materials, farm equipment, furniture, sporting goods, cans, container closures, lithographic plates, transformers, and in many other market and product areas.

A commonly employed technique for introducing anodizing direct current into a moving aluminum web is the use of a cathodic contact cell.

The so-called energy crisis has created a need to conserve energy sources by reducing the consumption of energy and/or by increasing productivity without increasing the amount of energy required. The anodizing of aluminum is an electrochemical process requiring substantial amounts of electrical energy and the present invention makes it possible to reduce by as much as one-half the amount of current required to anodize aluminum or, stated differently, the present invention makes it possible to anodize up to twice as much aluminum without increasing the electrical energy needed to conventionally anodize aluminum continuously using a contact cell arrangement.

SUMMARY

Basically, the present invention provides an improvement in the process for anodically oxidizing aluminum foil which involves coating one side of the aluminum foil with a material such as a polymeric material which is inert to the anodizing conditions prior to anodizing and thereafter electrolytically anodizing the uncoated side of the aluminum. Because only one side of the aluminum is anodized, anodizing can be carried out with half the electrical energy previously required to anodize both sides of aluminum sheet or the anodizing operation can be doubled in speed without using any more energy than was previously used to anodize two sides of aluminum sheet.

The laminate produced according to the invention provides a low-cost replacement for all aluminum articles such as presently used in the lithographic plate field.

DESCRIPTION OF THE DRAWING

The present invention will be more fully understood from the following description taken in conjunction with the accompanying drawing wherein.

DESCRIPTION

Figures 1A, 1B, 2A, 2B, 2C:
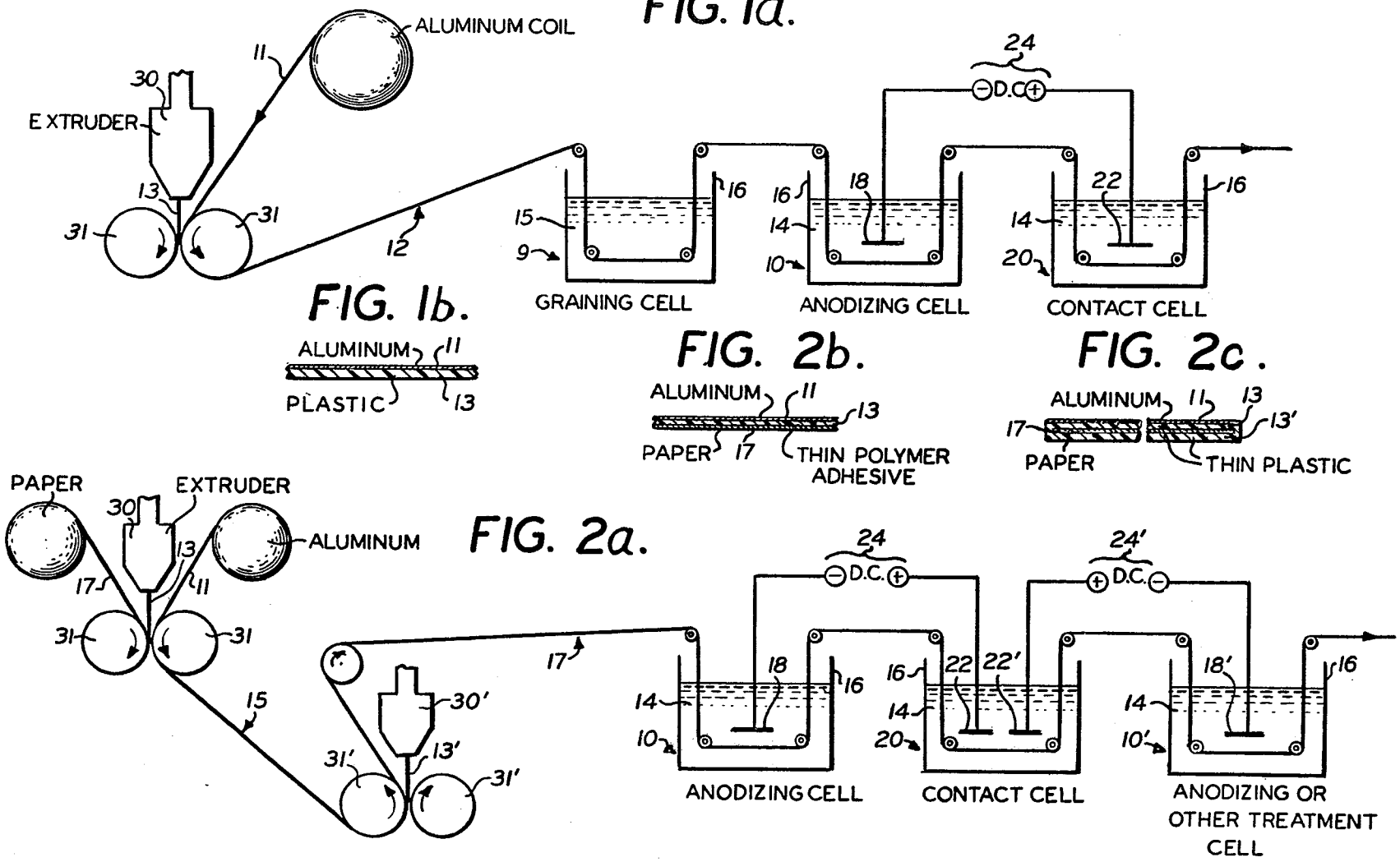
FIG. 1*a* is a schematic flow diagram illustrating a preferred embodiment for carrying out the present invention.
FIG. 1*b* is a sectional view of a laminate formed according to FIG. 1*a* prior to anodizing.
FIG. 2*a* is a schematic flow diagram illustrating a further preferred embodiment for carrying out the process of the invention.
FIGS. 2*b* and *c* are sectional views of laminates formed according to FIG. 2*a* prior to anodizing.

According to a preferred embodiment, aluminum foil in the form of a continuous web is continuously coated on one side thereof with a material which is inert to the anodizing conditions, for example an inert polymeric material such as polyethylene, polypropylene, ethylene vinyl acetate copolymer and similar and like polymeric materials. The coating operation is carried out using conventional techniques such as extrusion or hot melt coating prior to anodizing and the coated web is then preferably continuously anodized using known techniques preferably using a cathodic contact cell and more preferably, using the improved anodizing technique described in my earlier issued U.S. patents No. 3,865,700 issued Feb. 11, 1975, and No. 3,920,525 issued Nov. 18, 1975.

Aluminum is presently anodized in continuous strip form for use as base plates for lithographic printing plates in thicknesses ranging between 8 and 12 mils. The same thicknesses can be employed in the present invention with savings realized from the improved anodizing operation but preferably the amount of aluminum is reduced and replaced by an inert polymeric material for example, or even a much less expensive material such as lower grade aluminum, paper base materials and the like. In this manner, it is possible to use aluminum foil having a thickness of for example, 2 mils bonded to a layer of plastic or a combination of plastic and another low-cost material such as paper with a thickness of 8 to 10 mils.

Where aluminum of 2 mils thickness is employed with a backing of a polymeric material of 8 to 10 mils thickness, it is preferred to use a preformed or preextruded plastic sheet which is bonded to the aluminum foil using conventional techniques for example, by extrusion or hot melt coating a thin layer of plastic between the aluminum foil and the preformed or preextruded plastic sheet.

Referring now to the drawing and in particular to FIG. 1*a*, a continuous aluminum web 11 having a thickness of 8 mils for example, is passed between nip rolls 31 and a layer of plastic material 13 is applied to the nip of rolls 31 via extruder 30. FIG. 1*b* shows the resulting laminate produced. In FIG. 2*a* the aluminum web 11 and a continuous paper web 17 are both fed to the nip of rolls 31 and a layer of plastic material 13 is also applied at the nip via extruder 30. The resulting laminate is shown in FIG. 2*b*. Following this operation, the laminate 15 is again passed through nip rolls 31' and a second layer of plastic 13' is applied to the back or paper bonded side of the laminate 15 via extruder 30'. The structure of the laminate 17 is shown in FIG. 2*c*. To prevent wicking during the anodizing operation, the paper web 17 is preferably narrower than the width of the aluminum web 11. By making the paper 17 narrower than the aluminum web 11, the plastic layers 13 and 13' effectively encapsulate the web 17 which prevents liquid baths used in the anodizing operation from coming into contact with the web 17 thus preventing wicking and swelling. In the embodiment shown in FIG. 2a, another material in coil form such as lower grade aluminum foil can replace the paper web 17.

As is well known in the art, the aluminum web 11 can be cleaned, degreased or otherwise pretereated using conventional techniques before coating or bonding as described herein and after being anodized, the composite laminate can be sealed, dyed or otherwise post-treated using conventional techniques. One such post-treating rechniques is a silicating treatment of the anodically oxidized layer according to my U.S. Pat. No. 3,181,461 issued May 4, 1965.

FIGS. 1a and 2a illustrate preferred methods for anodizing employing techniques disclosed in my aforementioned patents No. 3,865,700 and No. 3,920,525. In FIG. 1a, the extrusion coated laminate is first grained or etched to increase the surface area of the aluminum to be anodized and this can be carried out using mechanical, chemicl or electrochemical techniques. In FIG. 1a, a chemical etching tank 9 is shown containing a conventional etchant such as ammonium bifluoride. After passing through the graining or etching cell 9, the extrusion coated aluminum web 12 passes through an anodizing cell 10 followed by a contact cell 20. Each cell including graining cell 9 includes a suitable tank member 16 for containing an electrolyte 14 or an etchant 15 as the case may be. The anodizing cell 10 has a cathode 18 therein connected to a source of direct current 24. The contact cell 20 has an anode 22 therein which is connected to the same source of direct current 24. The aluminum web 12 continually passes through the anodizing cell 10 followed by the contact cell 20 with the aid of conventional guide rollers positioned as shown in FIG. 1a. The anodizing direct current is introduced into the web 12 and the contact cell 20. Web 12 has an anodized oxide coating formed thereon on the uncoated side thereof in the anodizing cell 10 before entering the contact cell 20 by the action of the direct current introduced into the web 12 in the contact cell 20.

In FIG. 2a, the composite aluminum/paper laminate with one exposed side of aluminum is continuously anodized in a further preferred embodiment involving the use of a first anodizing cell 10, a contact cell 20 following the first anodizing cell 10 and a third anodizing or other electrolytic treatment cell 10' following the contact cell 20. As in the case of the embodiment shown in FIG. 1a, the exposed aluminum side of the composite web laminate 17 can be grained or etched prior to anodizing as is well known in the art, for example, as illustrated in FIG. 1a.

In FIG. 2a, the second anodizing cell 10' contains a cathode 18' which is connected to a second source of direct current 24'. The contact cell 20 contains a second anode 22' which is connected to the same source of direct current 24'. Thus, by utilizing the preferred embodiment shown in FIG. 2a with a contact cell 20 between two anodizing cells 10 and 10', the direct anodizing current introduced into the contact cell 20 from the two separate sources of direct current 24 and 24', travels in both directions, thus effectively doubling the current carrying capacity of the moving composite aluminum web laminate 17. Because only one side of the composite laminate 17 is being anodized in FIGS. 1a and 2a, the throughput rate can be doubled without increasing the amount of electrical energy needed to anodize both sides of an aluminum web or the throughput rate can remain the same as in the anodizing of two sides of aluminum web and the amount of electrical energy required can be cut approximately in half.

Instead of a second anodizing treatment in cell 10', which reinforces and adds to the outside coating formed in cell 10, a further electrolytic treatment wherein the web 17 is positive can be carried out in cell 10'. For example, an electrophoresis operation can be carried out and the embodiment shown in FIG. 2a in cell 10' or 20 whereby resin or lacquer particles are deposited in or on the pores of the oxide coating formed in cell 10.

It is also possible to electroplate the anodically oxidized surface of the aluminum laminates 12 and 17 employing electroplating techniques as described in my patents U.S. No. 3,865,700 and No. 3,920,525 and more particularly, in my U.S. Pat. No. 3,929,594 issued Dec. 30, 1975.

As an example of the present invention, aluminum web 3 feet wide having a thickness of 8 to 10 mils is degreased using a conventional alkaline cleaner and is then continuously extrusion coated with 1 or 2 mils of polyethylene using an extrusion coater or a hot melt fountain coater such as manufactured by Black-Clawson Company. The coated laminate is then chemically grained using 5% aqueous ammonium bifluoride in a graining cell. Anodizing is carried out in a 20 ft. long cell at 40° C. in 20% by wt. aqueous sulfuric acid electrolyte using a current density of 40 amps. per sq. ft. and a throughput rate of 80 ft. per min. As compared to a similar process where both sides of an aluminum web are anodized, the same throughput rate and degree of anodizing can only be achieved by doubling the current density or only one-half of the throughput rate is achieved by using the same current density.

In FIG. 2a, aluminum foil 11 having a thickness of 2 mils is bonded to a narrower paper web 17 having a thickness of 6 to 8 mils via a 1 or 2 mil thickness polyethylene web 13 extrusion coated between webs 11 and 17 via extruder 30 and nip rolls 31. To encapsulate the paper web 17 for the anodizing operation to prevent wicking and swelling, a second 0.5 mil thickness layer of polyethylene 13' is applied via extruder 30 and nip rolls 31' (FIG. 2c). Anodizing is carried out as in the above example.

When making base plates for lithographic plates according to the invention, tempered aluminum must be employed. Softer aluminum foil is not suitable because it will tear or rip when engaged by the holders or grippers of a conventional lithographic printing machine. Tempered aluminum generally has a temper rating of between H12 and H19 where direct cold reduction is employed or between H22 and H27 where a combination of cold reduction and back annealing are employed, as specified by the American Aluminum Association in *Aluminum Standards and Data* published by the Association. Such base plates are coated with a light-sensitive material, exposed to actinic radiation and developed as is well known in the art, for example, as described in my patents No. 3,131,461 and No. 3,773,514.

The light-sensitive layer or coating used in the invention may be formed from a host of photochemical materials known in the art. Such light-sensitive materials include dichromated colloids, such as those based on organic colloids, gelatin, process glue, albumens, caseins, natural gums, starch and its derivatives, synthetic resins, such as polyvinyl alcohol and the like; unsaturated compounds such as those based on cinnamic acid and its derivatives, chalcone type compounds, stilbene compounds and the like; and photopolymerizable compositions, a wide variety of polymers including vinyl polymers and copolymers such as polyvinyl alcohol, polyvinyl acetals, polyvinyl acetate vinyl sorbate, polyvinyl ester acetal, polyvinyl pyrrolidone, polyvinyl butyrol, halogenated polyvinyl alcohol; cellulose based polymers such as cellulose-acetate hydrogenphthalate, cellulose alkyl ethers; urea-formaldehyde resins; polyamide condensation polymers; polyethylene oxides; polyalkylene ethers, polyhexamethylene adipamide; polychlorophene; polyethylene glycols and the like. Such compositions utilize as initiators carbonyl compounds, organic sulphur compounds, peroxides, redox systems, azo and diazo compounds, halogen compounds and the like. These and other photochemical materials including their chemistry and uses are discussed in detail in a text entitled *Light-Sensitive Systems,* Jaromir Kosar, John Wiley and Sons, Inc. New York, 1965. Diazo resins are particularly preferred in those instances where the light-sensitive structure is utilized as a printing plate for lithographic or letterpress printing.

The laminate of the invention using tempered aluminum can thus be used as base plates for so-called wipe-on lithographic printing plates or for pre-sensitized lithographic printing plates.

Another use for laminates of the invention is in the field of reflectors for lighting fixtures. Such reflectors are presently made from aluminum which is chemically brightened. Thicknesses range between 20 and 40 mils. By employing the laminates of the invention, the amount of aluminum can be reduced to the 2–4 mil range thus realizing great savings in processing and material costs. Moreover, super-purity aluminum (at least 99.85% Al) can be employed which means that the chemical brightening step can be eliminated.

A further use for laminates of the invention is in the field of name plates. By employing a colored plastic for the layer 13 as shown in FIG. 1*b*, it becomes possible to remove selected portions of the anodized aluminum layer 11, e.g., by etching or scribing, to expose the underlying plastic layer 13 in a desired fashion. Color contrast can be obtained, for example, by use of a black plastic layer 13 which results in a black-silver contrast name plate. The anodized foil 11 can also be dyed, for example, to provide a gold-black contrast name plate.

What is claimed is:

1. Laminate comprising an aluminum foil bonded on one side to a second member having a smaller area than the aluminum foil, a coating over said bonded side of a polymeric material which is inert to anodizing conditions to encapsulate the second member between the coating and the aluminum foil and an anodically oxidized layer on the other side of the aluminum foil with the encapsulated second member.

2. Base plate of lithographic plates comprising the laminate of claim 1 wherein the aluminum foil is tempered.

3. Lithographic printing plate comprising the base plate of claim 2 coated with a light-sensitive material.

4. Reflector comprising the laminate of claim 1 wherein the aluminum foil has a purity of at least 99.85% aluminum.

5. Laminate of claim 1 wherein the second member has a color which contrasts with the aluminum foil.

6. Laminate of claim 1, wherein the second member comprises paper base material.

7. An anodized aluminum foil laminate comprising an aluminum foil; a second member having a smaller area than the aluminum foil and bonded to one side thereof; a coating over the bonded side of a polymeric material which is inert to anodizing conditions, to encapsulate the second member between the coating and the aluminum foil; and an oxidized layer on the other side of the aluminum foil formed by anodically oxidizing the aluminum foil after said one side is bonded and coated.

8. A continuous web of anodized aluminum laminate comprising: an aluminum web; a second web which is narrower than the aluminum web and is bonded to one side thereof; a continuous coating over the bonded side of a polymeric material inert to anodizing conditions to encapsulate the second web; and an oxidized layer on the other side of the aluminum web formed by continuous anodically oxidizing the aluminum web after said one side has been bonded and coated.

* * * * *

UNITED STATES PATENT AND TRADEMARK OFFICE

CERTIFICATE OF CORRECTION

PATENT NO. : 4,131,518

DATED : December 26, 1978

INVENTOR(S) : Howard A. Fromson

It is certified that error appears in the above-identified patent and that said Letters Patent are hereby corrected as shown below:

Column 4, line 59, "3,131,461 should read -- 3,181,461--.

Signed and Sealed this

*Third* Day of *July 1979*

[SEAL]

*Attest:*

*Attesting Officer*

LUTRELLE F. PARKER

*Acting Commissioner of Patents and Trademarks*